US006178554B1

(12) United States Patent
Pake et al.

(10) Patent No.: US 6,178,554 B1
(45) Date of Patent: Jan. 30, 2001

(54) HAND PROTECTOR

(76) Inventors: Charles W. Pake, 139 Page Pl., Emerald Isle, NC (US) 28594; Melton C. Causey, 283 Ervintown Rd., Richlands, NC (US) 28574

( * ) Notice: Under 35 U.S.C. 154(b), the term of this patent shall be extended for 0 days.

(21) Appl. No.: 09/302,718

(22) Filed: Apr. 30, 1999

Related U.S. Application Data

(60) Provisional application No. 60/083,969, filed on May 1, 1998.

(51) Int. Cl.[7] ..... A41D 13/00

(52) U.S. Cl. ..... 2/20; 2/160

(58) Field of Search ..... 2/158, 159, 16, 2/20, 160, 161.6; 15/227; 150/154, 155; 602/21, 22, 61, 62

(56) References Cited

U.S. PATENT DOCUMENTS

| | | | | |
|---|---|---|---|---|
| 456,230 | * | 7/1891 | Wilson | 2/20 |
| 1,654,161 | * | 12/1927 | Diaz et al. | 15/227 |
| 2,205,957 | | 6/1940 | Kinkis . | |
| 2,345,730 | * | 4/1944 | Cox | 15/227 |
| 2,695,999 | * | 12/1954 | Arnold | 2/20 |
| 2,952,021 | * | 9/1960 | Finn | 2/20 |
| 4,059,870 | | 11/1977 | Finkleman . | |
| 4,071,921 | * | 2/1978 | Jury | 15/227 |
| 4,551,886 | | 11/1985 | Couche et al. . | |
| 4,670,930 | * | 6/1987 | Lu | 2/158 |
| 4,980,943 | * | 1/1991 | Barber | 15/227 |
| 5,052,057 | * | 10/1991 | Fetner | 2/158 |
| 5,345,608 | | 9/1994 | Mergens et al. . | |
| 5,377,378 | * | 1/1995 | Cutler | 15/227 |
| 5,479,660 | | 1/1996 | Najac . | |
| 5,482,500 | | 1/1996 | Boettner et al. . | |
| 5,509,143 | * | 4/1996 | Yates et al. | 2/158 |
| 5,566,390 | | 10/1996 | Clancy . | |
| 5,592,694 | | 1/1997 | Yewer . | |
| 5,599,228 | | 2/1997 | Thibault . | |
| 5,603,679 | | 2/1997 | Reis . | |

* cited by examiner

*Primary Examiner*—John J. Calvert
*Assistant Examiner*—Katherine Moran
(74) *Attorney, Agent, or Firm*—Rhodes & Mason, PLLC

(57) ABSTRACT

An easily removable mitt or pad of a flexible cut-resistant material to be worn on the palm and about the wrist to protect at least the user's palm area. The pad, which preferably has an oval periphery, includes a hand-receiving opening for insertion of the user's hand. The opening has a diameter greater than the diameter of the user's wrist, but greater than the diameter of the user's hand, so that the pad can be easily separated from the palm area and hand beneath the user's hand when it is not needed.

9 Claims, 2 Drawing Sheets

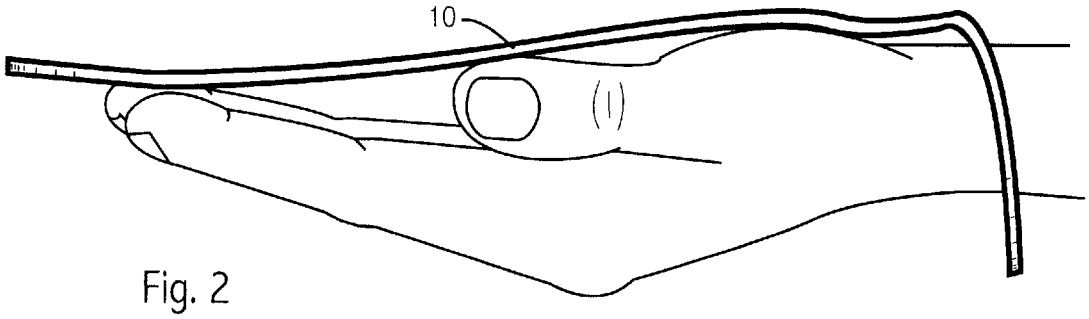
Fig. 2
Fig. 3
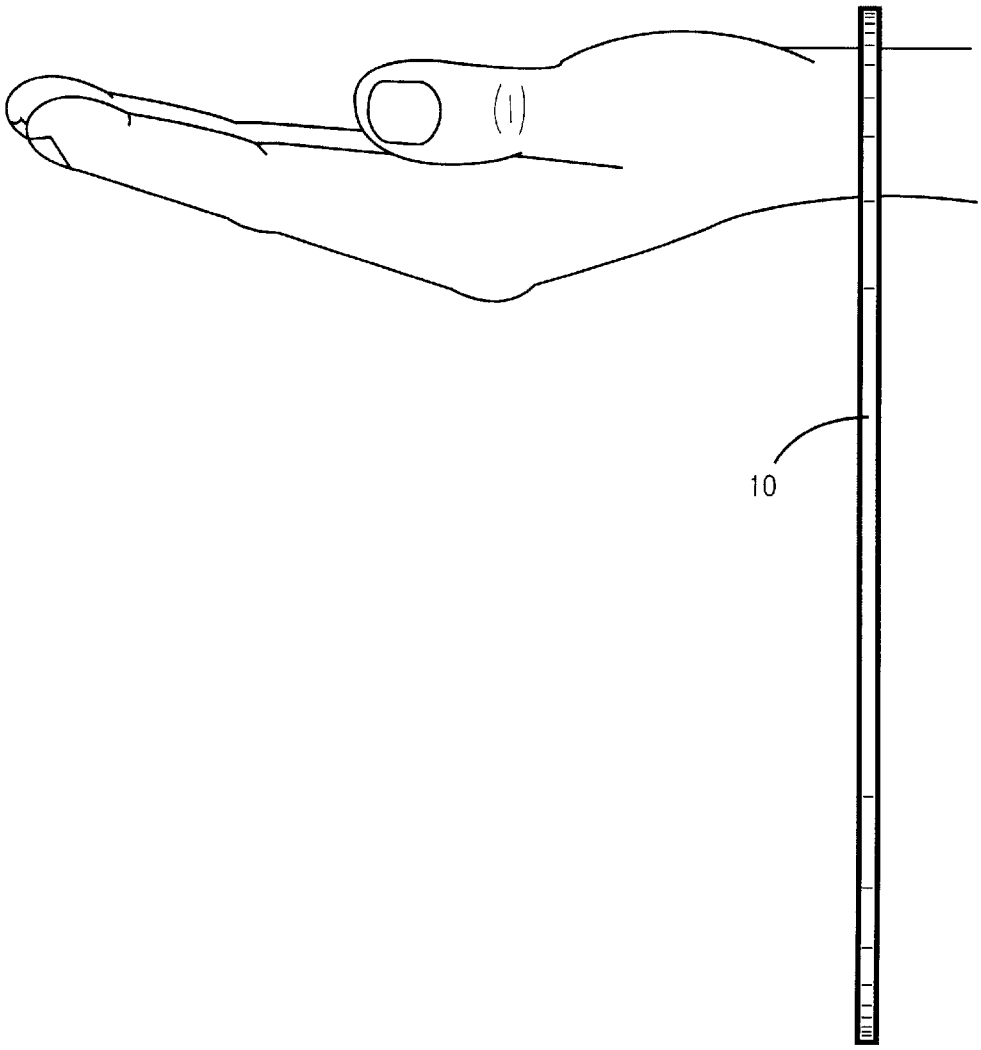

HAND PROTECTOR

This application claims the benefit of U.S. Provisional No. 60/083,969 filed May 1, 1998.

BACKGROUND OF THE INVENTION (1) Field of the Invention

The present invention relates generally to a device for protecting a user's hand, and in particular to a glove or mitt to prevent injury to a user's hand during the opening of shellfish, such as oysters.

(2) Description of the Prior Art

Numerous devices are described in the prior art that purport to protect a user's hand from injury when the user is engaged in various activities. Generally, these devices include a pad or covering that is positioned over the user's palm, and often inner finger surfaces, and some means for securing the device to the user's hand during use.

For example, U.S. Pat. No. 2,205,957 to Kinkis describes a hand shield comprised of a flexible, rectangular sheet-like material that includes a slot parallel to one end. When used, the user's hand is pushed or forced through the slot, and the sheet-like material is positioned over the user's palm. The Kinkis device is used primarily during handling of materials such as tin or steel sheets, plate glass, bricks, or the like.

The Kinkis device, as well as other prior art devices, are primarily adapted to be worn by the user during the entire time that the user is involved in the task involving the handling of sharp objects. These prior art devices are primarily designed to ensure that the device remains securely on the user's hand.

Some activities, however, involve manipulation activities of short duration during which it is necessary to cover the hand for a short periods of time, separated by periods when it is necessary to free the hand for other activities between these manipulation activities. In such instances, these prior art devices are inconvenient to use, due to the difficulty and time required to put the device onto the hand, and remove it during times when it is not needed. An inexpensive device that could provide protection for a user's hand, while being easy to don and remove would be of considerable value.

SUMMARY OF THE INVENTION

The present invention is directed to a hand covering that will protect the user's palm and finger inner surfaces while the user is engaged in the manipulation of items that might injure, e.g., stick or abrade, the user's hand, but which is easily removed when not needed, so that the user can engage in other activities. When not is use, the device can be held in a convenient position for easy and quick placement on the user's hand, so that the user can engage in another manipulative activity.

The hand covering or device of the present invention is basically a pad or mitt that is of a size to fit over at least the palm of a user's hand, and preferably over the entire inside of the user's hand. The shape of the pad is preferably planar with an oval or circular periphery that generally approximates the dimensions of the user's hand or area to be covered. However, other shapes can be used for convenience of manufacture, for advertising purposes, etc.

The pad includes a hand receiving opening near one end or edge through which the user's hand is inserted, so that the user's wrist is within the are of the opening when the pad is over the user's hand. Importantly, this opening is large enough to fit loosely over the user's wrist without significant binding, while still being held by the size of the user's hand. That is, the diameter of the opening is greater than the diameter of the user's wrist, but less than the diameter of the user's hand. Preferably, the diameter of the opening is at least 10% greater than the diameter of the user's wrist, and preferable is at least 20% to 50% greater.

The opening may be of various configurations. For example, the opening may be of an oval shape, with the long dimension of the oval being greater than the width of user's wrist, and a short dimension of the oval being greater than the thickness of the user's wrist. The opening can also be circular, rectangular, etc.

Thus, the opening loosely encircles the user's wrist with the pad covering the palm of the hand when the mitt is being used in a manipulative activity, such as open oysters or other shellfish. When shucking oyster, the user can simply place the oyster on the pad over the palm of the hand and squeeze the pad or mitt to grip the oyster. The oyster is then easily opened in a conventional manner with an oyster knife or other tool, without the user being concerned that slippage of the tool may cause injury to the hand.

However, due to the looseness of the generally circular hand insertion opening, removal of the mitt after opening of the oyster is not required. The loose opening permits the mitt to be moved beneath the hand, where it can hang loosely from the wrist, thereby enabling the user to eat the shelled oyster, or engage in another activity, without the need to remove the mitt. After the oyster is eaten, the mitt can be easily replaced to shell or shuck another oyster.

Accordingly, it is an aspect of the present invention is to provide an easily removable mitt or pad of a flexible cut-resistant material to protect at least the user's palm area, while being easily separable when not used. Other aspects of the present invention will become apparent to those skilled in the art after a reading of the following description of the preferred embodiment.

BRIEF DESCRIPTION OF THE DRAWINGS

FIG. 2 is a side view of FIG. 1.

FIG. 3 is a side view showing the mitt hanging from the user's wrist.

DETAILED DESCRIPTION OF THE INVENTION

Figure 1:
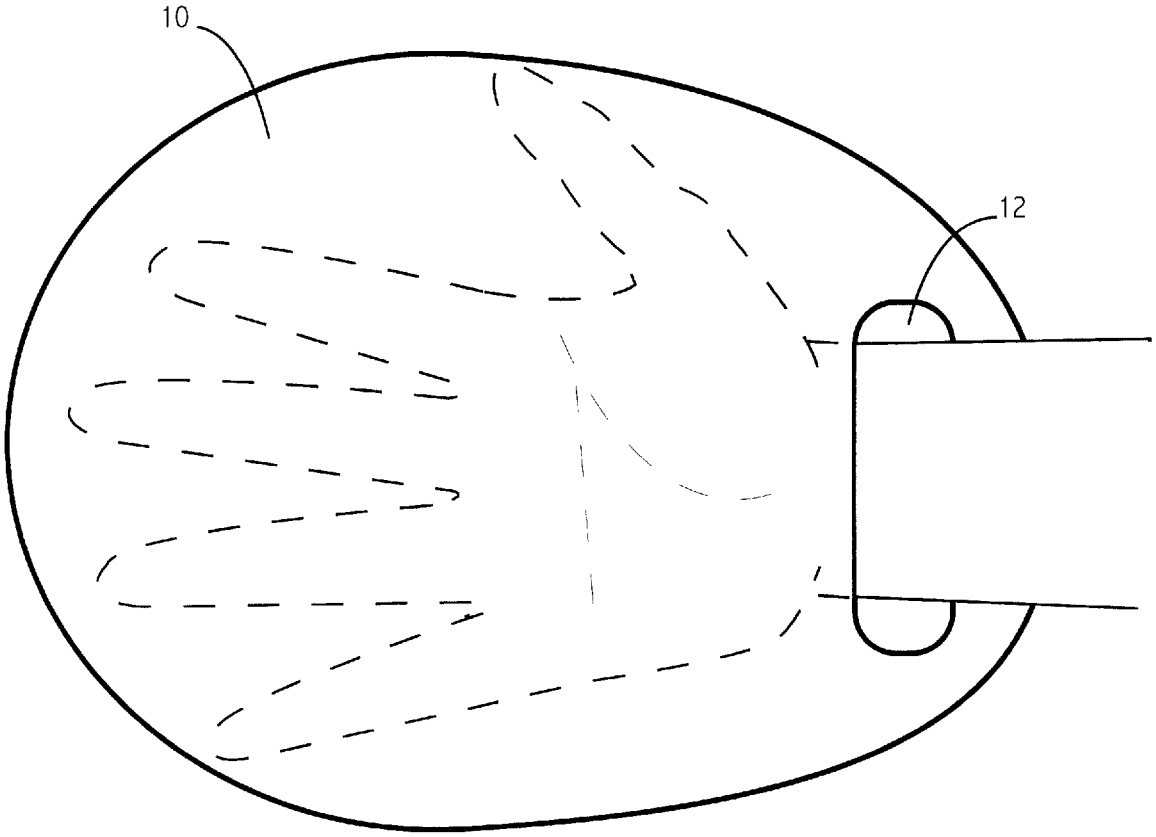
FIG. 1 is a top view showing the mitt supported on the inside of the user's hand.

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

As illustrated in the attached drawings, the present invention is comprised of a mitt including a pad 10 dimensioned to fit over at least the palm of a user's hand, and preferably over the entire inside of the user's hand. The material may be made from plastic, rubber, Kevlar, Spectra, or other flexible, resilient, cut-resistant material. The thickness of pad 10 will depend upon the properties from which it is formed. Generally, however, a pad thickness of one-sixteenth to one-fourth inch will be satisfactory. One or both surfaces of pad 10 can be textured to improve the grip.

Pad 10 includes an opening 12 adjacent one end. As illustrated, pad 10 has a lone dimension and a short dimension, with opening 12 being located adjacent one end of the long dimension. Opening 12 is sized to loosely encircle the user's wrist with pad 10 covering the palm of the hand when the mitt is being used to open oysters or other shellfish.

When used, the user simply inserts his or her hand through opening 12 so that opening 12 encircles the user's wrist, with pad 10 being positioned over the user's palm. An oyster, or other sharp item to be manipulated, is placed onto pad 10 in the palm area, and pad 10 is squeezed around the oyster.

After the oyster is opened and removed from pad 10, the user can simply rotate his or her hand to cause the pad to rotate from the palm and hand downwardly from the user's wrist due to the size of opening 12 relative to the size of the user's wrist. Thus, the user's hand is freed to eat the shelled oyster or engage in another activity without the need to remove the mitt. After the oyster is eaten, the mitt can be easily rotated back over the palm area to shell or shuck another oyster.

It will be understood that certain modifications and improvements can be made without departing from the spirit and scope of the invention. For example, loops can be added for finger insertion, or other means employed to temporarily secure the mitt to the user's hand. Also, advertising indicia can be placed upon one or both surfaces of the mitt. Such modifications and improvements have been deleted herein for the sake of conciseness and readability but are properly within the scope of the follow claims.

What is claimed is:

1. A protective easily removable device to be worn over the inside of the hand of a user to protect at least the palm area of the user's hand, said device comprising a flexible cut-resistant planar pad of a size adequate to cover at least the user's palm area, said pad including an oval hand-receiving opening within the plane of said pad for insertion of the user's hand, said opening having a diameter adapted to be at least 10% greater than the diameter of the user's wrist, but less than the diameter of the user's hand, said opening having a long dimension greater than the width of the user's hand, and a short dimension greater than the thickness of the user's wrist.

2. The device of claim 1, wherein said pad has an oval or circular periphery.

3. The device of claim 1, wherein said opening has an oval or circular periphery.

4. The device of claim 1, wherein said pad is formed from a material selected from the group consisting of plastic, rubber, aramid fibers and extended chain polyethylene fibers.

5. The device of claim 1, wherein said pad has a long dimension and a short dimension, said opening being located adjacent the periphery of said pad along said long dimension.

6. The device of claim 5, wherein said opening has a long dimension transverse to the long dimension of said pad.

7. The device of claim 1, wherein said pad has a thickness of from about one-sixteenth inch to about one-fourth inch.

8. The device of claim 1, wherein at least one surface of said pad is textured.

9. The device of claim 1, wherein at least one surface of said pad includes advertising indicia.

* * * * *